US007094138B2

(12) United States Patent
Chang

(10) Patent No.: US 7,094,138 B2
(45) Date of Patent: Aug. 22, 2006

(54) GRINDING DISC STRUCTURE

(76) Inventor: Jen-Pen Chang, No.252, Wuguang Rd., Wuri Shiang, Taichung County 414 (TW)

( * ) Notice: Subject to any disclaimer, the term of this patent is extended or adjusted under 35 U.S.C. 154(b) by 0 days.

(21) Appl. No.: 11/068,821

(22) Filed: Mar. 2, 2005

(65) Prior Publication Data

US 2005/0202769 A1 Sep. 15, 2005

(30) Foreign Application Priority Data

Mar. 9, 2004 (TW) ..... 93203573 U

(51) Int. Cl.
*B24B 23/00* (2006.01)

(52) U.S. Cl. ..... 451/359; 451/456; 451/548

(58) Field of Classification Search ..... 451/451, 451/456, 344, 359, 548
See application file for complete search history.

(56) References Cited

U.S. PATENT DOCUMENTS 5,105,585 A * 4/1992 Hampl et al. ..... 451/359
5,919,085 A * 7/1999 Izumisawa ..... 451/357
6,059,644 A * 5/2000 Manor et al. ..... 451/490
6,361,424 B1 * 3/2002 Manor et al. ..... 451/490

* cited by examiner

*Primary Examiner*—Jacob K. Ackun, Jr.
(74) *Attorney, Agent, or Firm*—Troxell Law Office, PLLC

(57) ABSTRACT

A grinding disc structure including an integrally formed main disc adapted to a dust-sucking cover body of a grinder. The main disc has multiple through holes nearly in parallel to an axis of the main disc. The main disc is further formed with multiple internal passages which are horizontally formed in the main disc corresponding to the through holes and nearly perpendicular to the axis of the main disc. The passages are tangential to the through holes. Two ends of each passage respectively communicate with the through hole and outer side around the main disc. The main disc has a complete bottom face to which a grinding layer can be fully adhered.

6 Claims, 5 Drawing Sheets

GRINDING DISC STRUCTURE

BACKGROUND OF THE INVENTION

The present invention is related to an improved grinding disc structure in which the main disc is integrally formed to simplify the assembling procedure of the grinding disc.

A conventional grinder is used to grind and buff a work piece. In grinding operation, powders and dusts are produced to contaminate the environment. This is harmful to the health of an operator.

Taiwanese Patent Application No. 91207022, entitled "grinding disc structure" discloses a grinder with dust-exhausting effect. The grinder includes a main disc 20 formed with an annular groove 21. The annular groove 21 communicates with several guide channels 22 arranged at equal angular intervals. The main disc 20 is further formed with several dust-exhausting holes 73. The grinder further includes a substrate 10 formed with several through holes 12 communicating with the interior of a cover body 53. A grinding layer 40 is adhered to or connected with the main disc 20. The grinding layer 40 is formed with several through holes 41 communicating with the annular groove 21 of the main disc 20.

The powder and dust produced during the grinding operation is sucked from the through holes 41 of the grinding layer and the guide channels 22 of the main disc 20 into the annular groove 21. The powder and dust then go through the annular groove 21, the dust-exhausting holes 23 and the through holes 31 of the substrate into the cover body 53. Then the powder and dust are exhausted with an exhauster.

The grinding disc 1 of the conventional grinder 50 is composed of the substrate 10 connected with the cover body 53, the main disc 20, the attachable plate 30 and the grinding layer 40. It is troublesome to assemble these components. Furthermore, the holes of the main disc 20, attachable plate 30 and the grinding layer 40 must be aligned with each other. This prolongs the assembling time. In addition, due to the annular groove 21 and guide channels 22 formed on one side of the main disc 20 facing the grinding layer 40, it is impossible to integrally form the main disc 20 and the attachable plate 30. The attachable plate 30 and the main disc 20 must be first separately formed and then connected with each other by adhesion. After the attachable plate 30 is adhered to the main disc 20, the annular groove 21 and the guide channels 22 are defined between the attachable plate 30 and the main disc 20 to form hollow sections with large area. This makes the attachable plate 30 tend to detach from the main disc 20, especially in the case that the grinder is unexpectedly dropped or thrown out in operation.

Therefore, it is tried by the applicant to provide a grinding disc in which the main disc is integrally formed to simplify the manufacturing of the grinding disc.

SUMMARY OF THE INVENTION

It is therefore a primary object of the present invention to provide an improved grinding disc structure including an integrally formed main disc adapted to a dust-sucking cover body of a grinder. The main disc has multiple through holes nearly in parallel to an axis of the main disc, whereby the powder and dust produced in grinding operation can be sucked into the cover body and exhausted therefrom. The main disc is formed with multiple internal passages respectively corresponding to the through holes. The passages are horizontally formed in the main disc and nearly perpendicular to the axis of the main disc. The passages are tangential to the through holes. Two ends of each passage respectively communicate with the through hole and outer side around the main disc. The main disc has a complete bottom face to which a grinding layer can be fully adhered.

The present invention can be best understood through the following description and accompanying drawings wherein:

DETAILED DESCRIPTION OF THE PREFERRED EMBODIMENTS

Figure 1:
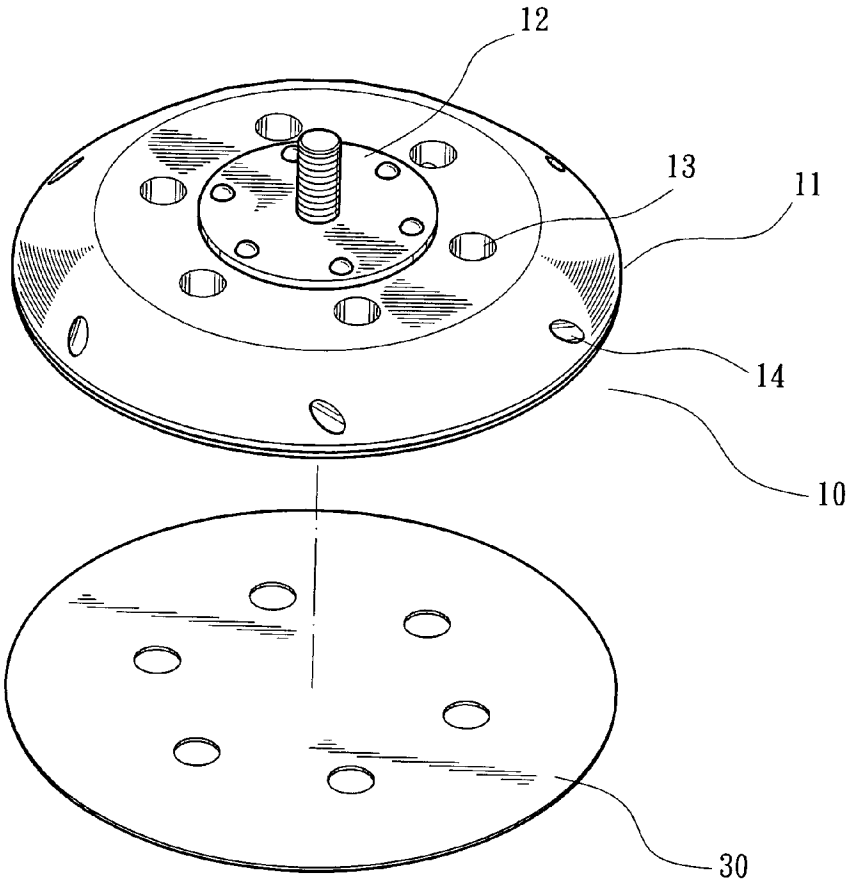
FIG. 1 is a perspective exploded view of the grinding disc of the present invention.
Figure 2:
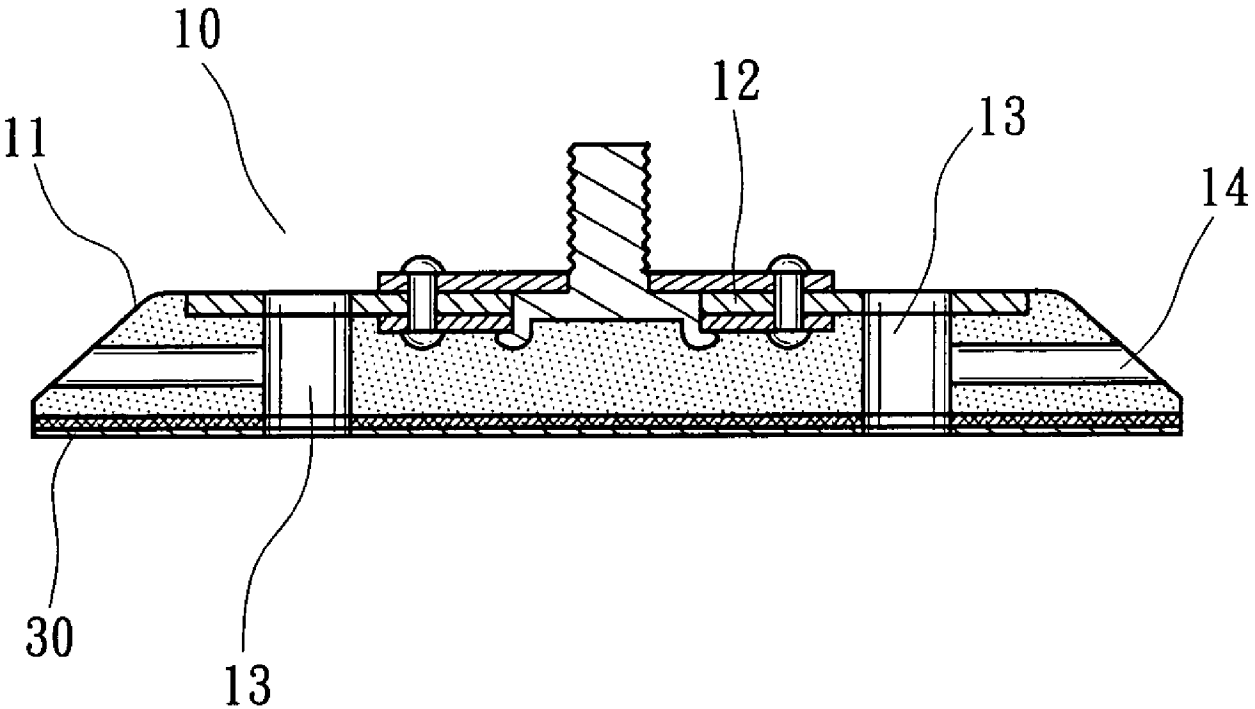
FIG. 2 is a sectional view according to FIG. 1.
Figure 4:
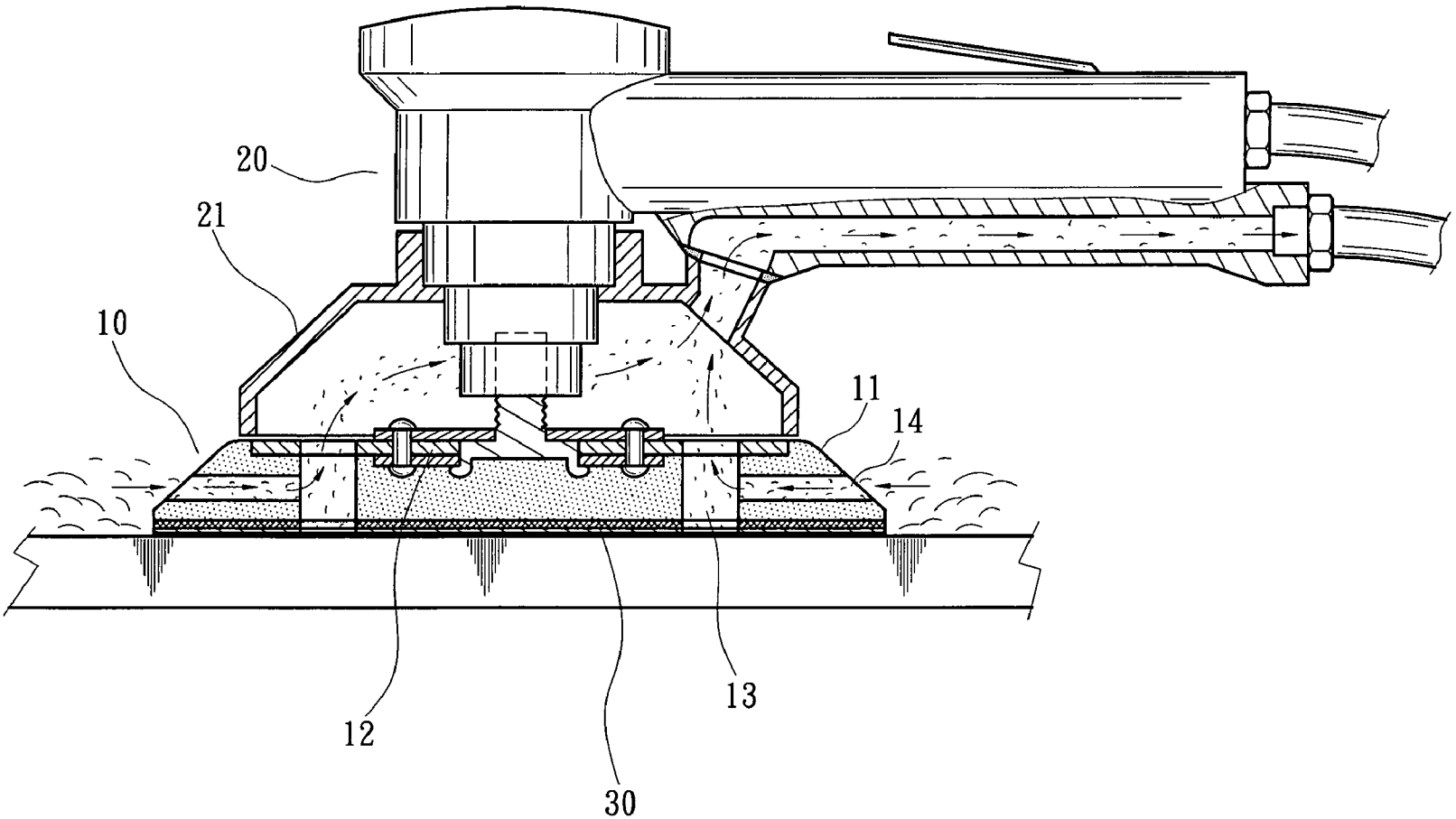
FIG. 4 is a side sectional view showing the operation of the grinder with the grinding disc of the present invention.

Please refer to FIGS. 1 and 2. The grinding disc 10 of the present invention includes a main disc 11 having a central section 12 for connecting with a grinder 20 and a cover body 21 (as shown in FIG. 4). The main disc 11 has multiple through holes 13 nearly in parallel to the axis of the main disc 11. At least one end of each through hole 13 communicates with the cover body 21, whereby the airflow, powder or dust can be sucked and exhausted through the cover body 21. The main disc 11 is formed with multiple internal passages 14 respectively corresponding to the through holes 13. The passages 14 are horizontally formed and nearly perpendicular to the axis of the main disc 11. Two ends of each passage 14 respectively communicate with the through hole 13 and outer side around the main disc 11.

Figure 3:
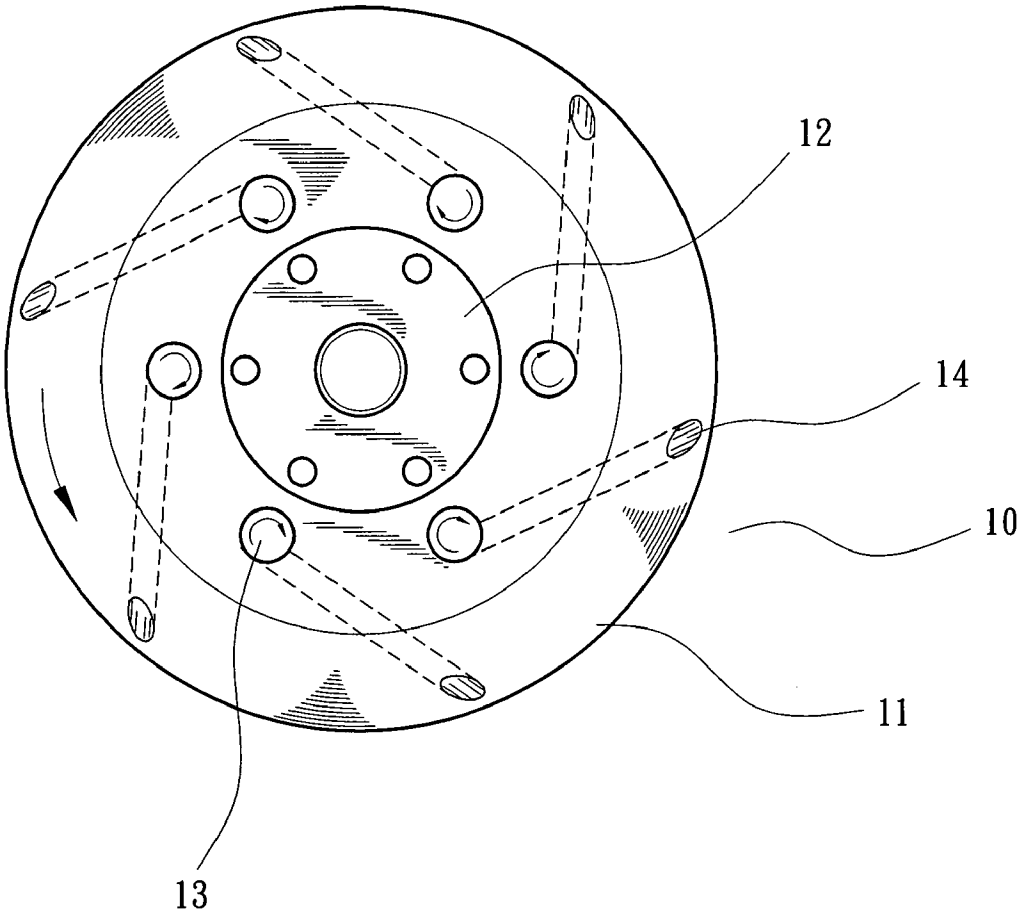
FIG. 3 is a top view of the grinding disc of the present invention.
Figure 3A:
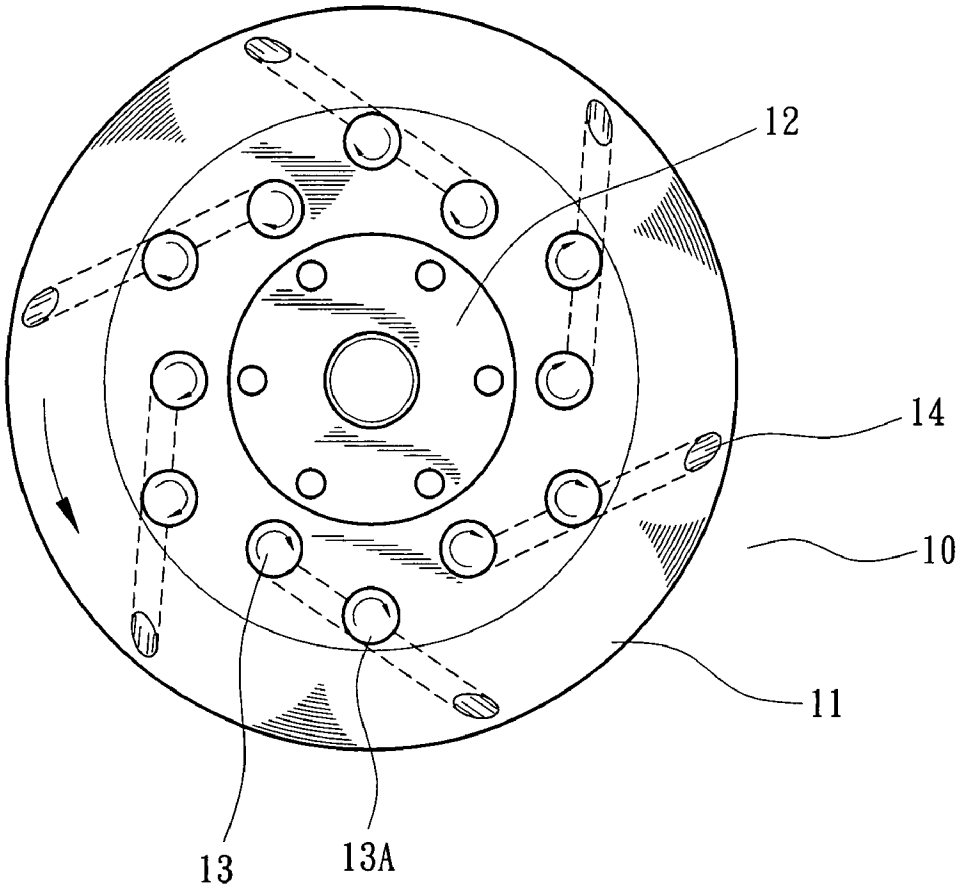
FIG. 3A is a top view of another embodiment of the grinding disc of the present invention.

FIG. 3 shows that the passages 14 are tangential to the through holes 13. When the external grinding powder or dust is sucked from outer end of the passage 14 into the through hole 13, a strong eddy is generated at the through hole 13. Therefore, the airflow with the powder or dust can go into the cover body 21 more smoothly and quickly. This helps in exhausting the dust as shown in FIG. 4. Referring to FIG. 3A, multiple through holes 13A can be additionally disposed on the main disc 1 near outer circumference thereof in the path of the passages 14. Accordingly, the dust-sucking range is enlarged and the dust can be more smoothly sucked and exhausted.

According to the above arrangement, the present invention has the following advantages:

1. In the conventional grinding disc, the attachable plate and the main disc are separately formed. Then the attachable plate is adhered to the main disc to together with the main disc define a passage. Such structure has poor rigidity. In contrast to the conventional grinding disc, the passages 14 of the grinding disc of the present invention are directly formed inside the main disc 11 so that the grinding disc has better rigidity.
2. The main disc is integrally formed with a mold instead of the separately formed main disc and attachable plate of the conventional device. Therefore, the components of the grinding disc are reduced so that it is unnecessary to twice process the grinding disc.

3. The main disc 11 of the present invention has a complete bottom surface. Therefore, the grinding layer 30 can be more firmly adhered to or connected with the main disc 11. Accordingly, in use of the grinder 20, the possibility of dropping of the grinding layer 30 is minimized.

4. In assembling procedure of the conventional device, the holes of the respective components must be aligned with each other. This is quite time-consuming. In contrast to the conventional device, the present invention has no such problem.

The above embodiments are only used to illustrate the present invention, not intended to limit the scope thereof. Many modifications of the above embodiments can be made without departing from the spirit of the present invention.

What is claimed is:

1. A grinding disc structure for a grinder comprising:

a) a main disc having:

i) a central section connected to a cover body of the grinder;

ii) a plurality of through holes spaced apart and positioned parallel to a center axis of the main disc, each of the plurality of through holes communicating with an interior of a cover body of the grinder; and iii) a plurality of straight internal passages spaced apart from a bottom of the main disc, each of the plurality of straight internal passages communicating with one of the plurality of through holes and an exterior side of the main disc; and b) a grinding layer connected to the bottom of the main disc.

2. The grinding disc structure according to claim 1, wherein the plurality of straight internal passages are located tangential to the plurality of through holes.

3. The grinding disc structure according to claim 1, wherein the plurality of straight internal passages are located perpendicular to plurality of through holes.

4. The grinding disc structure according to claim 1, wherein the main disc includes a plurality of additional through holes spaced apart and located closer to an outer circumference of the main disc than the plurality of through holes, one of the plurality of additional through holes communicating with each of the plurality of straight internal passages and being located tangentially thereto.

5. The grinding disc structure according to claim 2, wherein the main disc includes a plurality of additional through holes spaced apart and located closer to an outer circumference of the main disc than the plurality of through holes, one of the plurality of additional through holes communicating with each of the plurality of straight internal passages and being located tangentially thereto.

6. The grinding disc structure according to claim 3, wherein the main disc includes a plurality of additional through holes spaced apart and located closer to an outer circumference of the main disc than the plurality of through holes, one of the plurality of additional through holes communicating with each of the plurality of straight internal passages and being located tangentially thereto.

* * * * *